US009044979B2

(12) United States Patent
Somano

(10) Patent No.: US 9,044,979 B2
(45) Date of Patent: Jun. 2, 2015

(54) INKJET RECORDING APPARATUS

(71) Applicant: CANON KABUSHIKI KAISHA, Tokyo (JP)

(72) Inventor: Toshiaki Somano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/332,917

(22) Filed: Jul. 16, 2014

(65) Prior Publication Data

US 2015/0022587 A1 Jan. 22, 2015

(30) Foreign Application Priority Data

Jul. 19, 2013 (JP) ..... 2013-150363

(51) Int. Cl.
*B41J 2/01* (2006.01)
*B41J 25/304* (2006.01)

(52) U.S. Cl.
CPC ..... *B41J 25/304* (2013.01)

(58) Field of Classification Search
CPC ..... B41J 2/2107; B41J 2/01; B41J 11/42
See application file for complete search history.

(56) References Cited

U.S. PATENT DOCUMENTS 7,175,265 B2 * 2/2007 Tsuyama et al. ..... 347/85
7,527,371 B2 * 5/2009 Yanagi et al. ..... 347/104
8,317,297 B2 * 11/2012 Terada ..... 347/37

FOREIGN PATENT DOCUMENTS

JP 2007-160560 A 6/2007

* cited by examiner

*Primary Examiner* — Lamson Nguyen
(74) *Attorney, Agent, or Firm* — Canon U.S.A., Inc. IP Division

(57) ABSTRACT

An inkjet recording apparatus allows a recording head to be mounted or removed in or from a carriage at a replacement position in a region above a platen. The platen includes a short rib disposed at a position that faces an ejection port portion when the carriage moves to the replacement position and a long rib disposed at a position that faces a portion of the recording head other than the ejection port portion.

11 Claims, 10 Drawing Sheets

INKJET RECORDING APPARATUS

BACKGROUND OF THE INVENTION

1. Field of the Invention

The present invention relates to an inkjet recording apparatus.

2. Description of the Related Art

Inkjet recording apparatuses include a carriage having a recording head mounted therein. The recording head includes an ejection port for ejecting ink. The carriage is connected to part of a drive belt and moves together with the drive belt. The drive belt transfers the driving force of a drive motor.

The recording head is removably mounted in the carriage. If ink in the recording head is used up for recording operations, the recording head is replaced with a new one in order to continue the recording operation in which ink is ejected.

Japanese Patent Laid-Open No. 2007-160560 describes an inkjet recording apparatus including a recording head that is removable from the front of a carriage at a position outside the area of a platen.

In addition, inkjet recording apparatuses including a recording head having a replacement position above a platen (that is, inside the area of the platen) have been developed. In such inkjet recording apparatuses, a user operates in front of a carriage above the platen at the replacement position to press down the recording head with respect to the carriage and remove the recording head. According to the configuration of the apparatus, when the recording head is removed, an ejection port portion of the recording head may be brought into contact with the platen. Accordingly, at the replacement position, a rib formed on the platen needs to be inclined downward to a lower position so that a gap formed between the recording head and the platen increases.

According to the inkjet recording apparatus described in Japanese Patent Laid-Open No. 2007-160560, since the recording head is replaced in an area outside the platen, a space for the replacement operation is additionally needed.

Furthermore, in inkjet recording apparatuses having a rib of the platen that is inclined downward to a lower position at the replacement position, a recording medium may not be stably conveyed on the platen.

SUMMARY OF THE INVENTION

To solve the above issue, the present invention provides an inkjet recording apparatus capable of stably conveying a recording medium on the platen while protecting the ejection port portion of the recording head from being damaged when the recording head is replaced.

According to an aspect of the present invention, an inkjet recording apparatus includes a conveying unit configured to convey a recording medium in a conveyance direction, a recording head having an ejection port portion for ejecting ink onto a recording medium, a carriage having the recording head removably mounted therein, where the carriage is movable in a direction crossing to the conveyance direction and is movable to a replacement position at which the recording head is ready for replacement, and the replacement position is located in an area which allows the recording medium to pass therethrough, a platen configured to support the recording medium at a position facing the recording head, and a contacting rib provided on the platen at a position that faces a portion of the recording head other than an ejection port portion when the carriage having the recording head mounted therein is moved to the replacement position. The contacting rib extends on the platen in the conveyance direction.

Further features of the present invention will become apparent from the following description of exemplary embodiments with reference to the attached drawings.

DESCRIPTION OF THE EMBODIMENTS

Exemplary embodiments of the present invention are described below with reference to the accompanying drawings.

First Exemplary Embodiment

Figure 1:
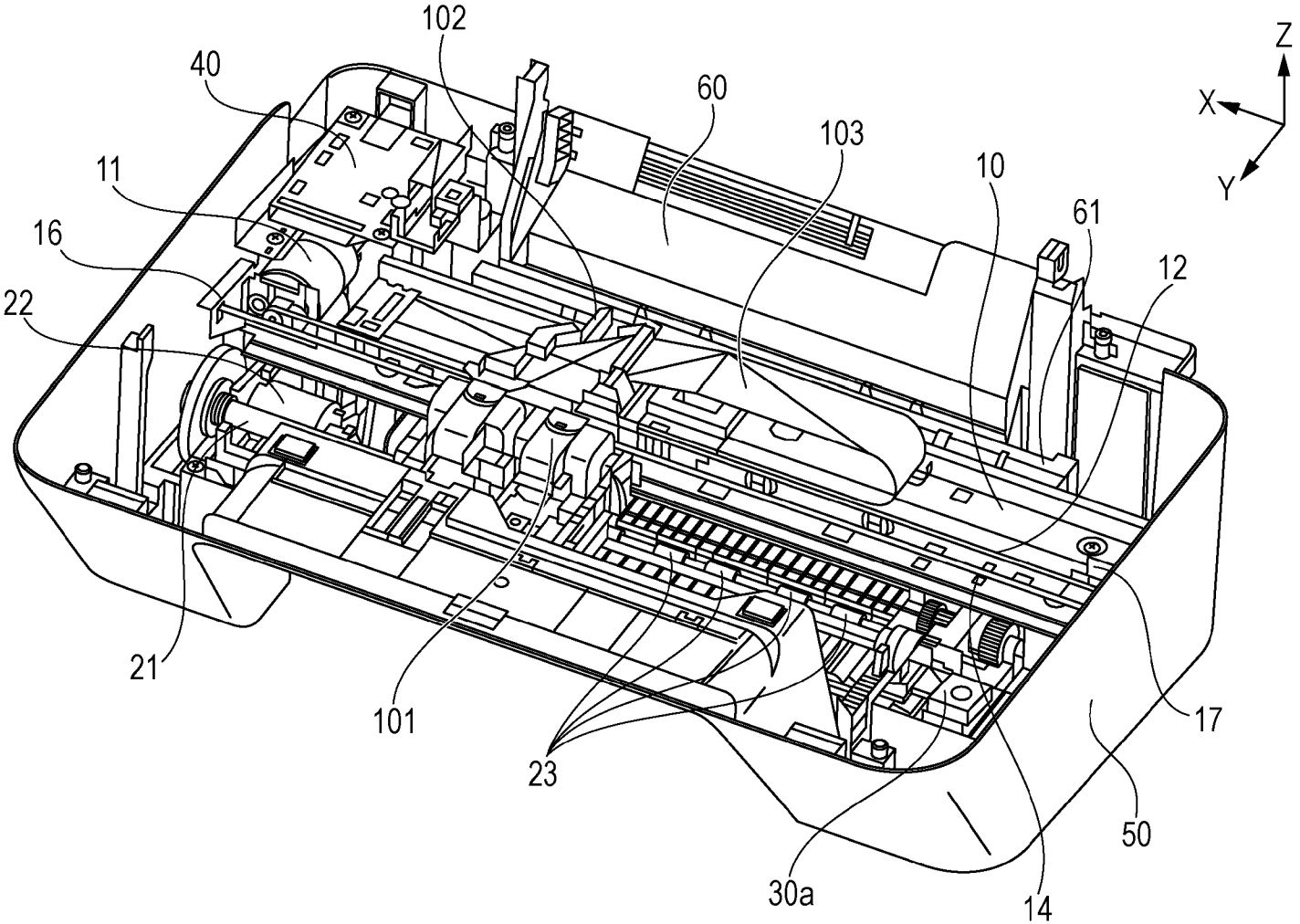
FIG. 1 is a perspective view of the internal structure of an inkjet recording apparatus according to an embodiment of the present invention.
Figure 2:
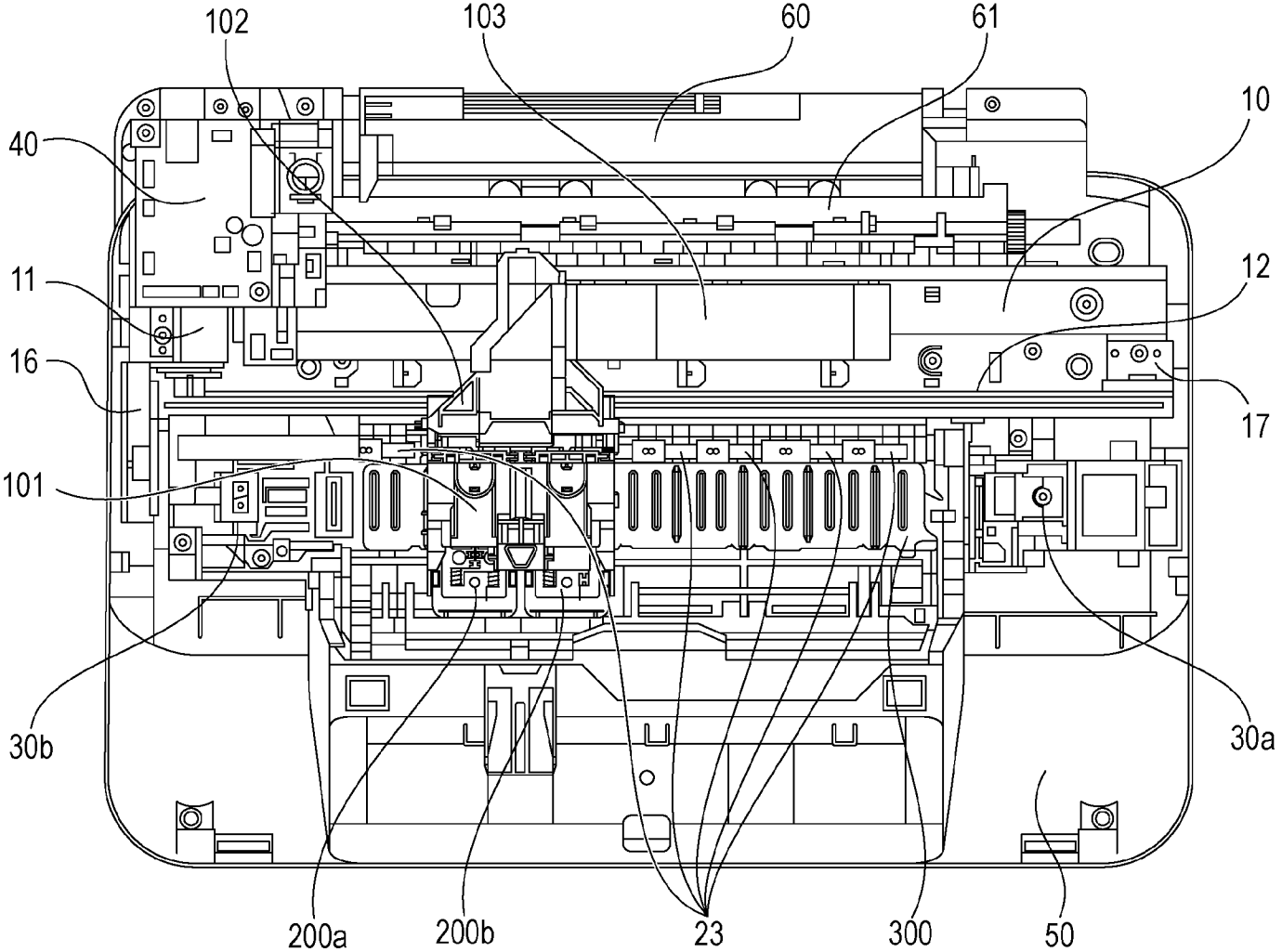
FIG. 2 is a front view of the internal structure of the inkjet recording apparatus.

FIGS. 1 and 2 are a perspective view and a front view of the internal structure of an inkjet recording apparatus, respectively. Data to be recorded is transmitted from a host apparatus (not illustrated) and is stored in a control unit (not illustrated) disposed in a control circuit board 40. Upon receiving an instruction from the control unit, the inkjet recording apparatus starts a recording operation.

When the recording operation starts, a conveyance motor 22 rotates. The rotation of the conveyance motor 22 pivotally moves a swing arm 61 connected to the conveyance motor 22 via a gear train. The swing arm 61 rotatably supports a feeder roller (not illustrated). Rotation of the swing arm 61 causes the feeder roller to be brought into contact with a recording medium (not illustrated) loaded on a loading unit 60. The feeder roller is connected to the conveyance motor 22 via a gear train. The rotation of the conveyance motor 22 generates a driving force of the feeder roller, which feeds the recording medium.

The recording medium fed by the feeder roller is pinched by a conveyance roller 21 and a pinch roller 23. The pinch roller 23 is urged against the conveyance roller 21 by a pinch roller spring (not illustrated). After the recording medium is pinched by the conveyance roller 21 and the pinch roller 23, the swing arm 61 rotates in the opposite direction and, thus, the feeder roller is separated from the recording medium.

The conveyance roller 21 rotates due to the driving force of the conveyance motor 22 received via gears. The rotation of the conveyance roller 21 conveys the recording medium pinched by the conveyance roller 21 and the pinch roller 23 onto a platen 300, which defines a recording area.

A recording operation is performed on the recording medium conveyed into the recording area using a recording head 200. The recording head 200 is mounted in a carriage 101. The carriage 101 having the recording head 200 mounted therein moves back and forth in a direction that intersects a conveyance direction of the recording medium.

The carriage 101 has a carriage cover 102 fixed thereto by a screw. The carriage cover 102 is supported so as to be scannable above a main chassis 10. The main chassis 10 is fixed to a bottom 50.

Upon receiving the driving force of a carriage motor 11 via a carriage belt 12, the carriage 101 moves back and forth. The carriage belt 12 is entrained between the carriage motor 11 and an idler pulley (not illustrated).

A code strip 14 is entrained between an HP plate 16 and a pulley plate 17 fixed to the main chassis 10 by screws. By reading the code strip 14 using an encoder (not illustrated), the inkjet recording apparatus can eject ink from the recording head 200 to the recording medium at appropriate timings. The encoder is mounted in the carriage 101.

After an operation performed by the recording head 200 to form an image for one line is completed, a conveying operation is performed by the conveyance roller 21 so that the recording medium is conveyed by a desired distance. By alternately repeating the image forming operation and the conveying operation, recording is performed over the entire recording area of a surface of the recording medium.

Figure 3A:
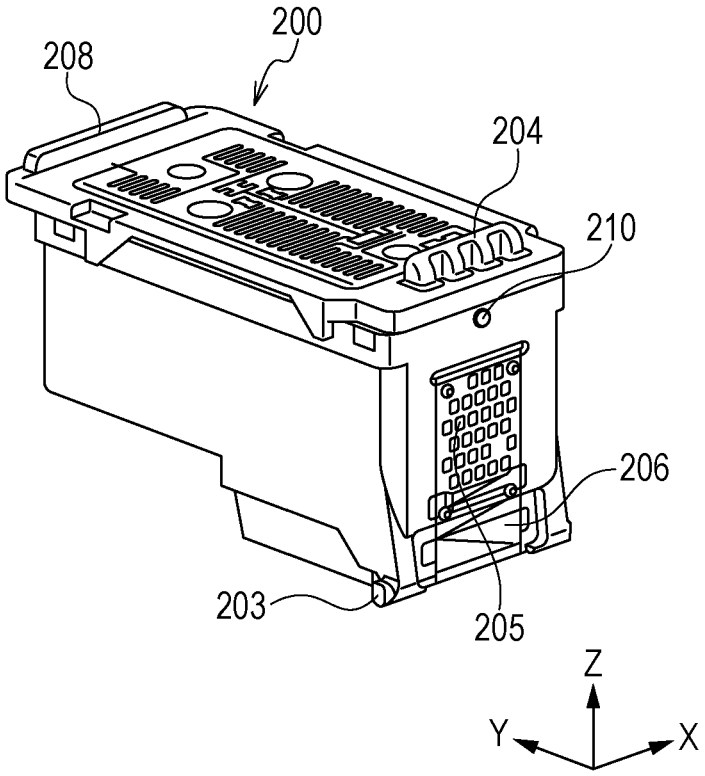
FIGS. 3A and 3B illustrate a recording head.

FIG. 3A is a perspective view of the recording head 200 having a pressing portion 204. The recording head 200 includes a rough locator 203, the pressing portion 204, a conductor exposed surface 205, a flat panel cable (FPC) 206, a grip part 208, and a head top abutment surface 210.

Figure 3B:
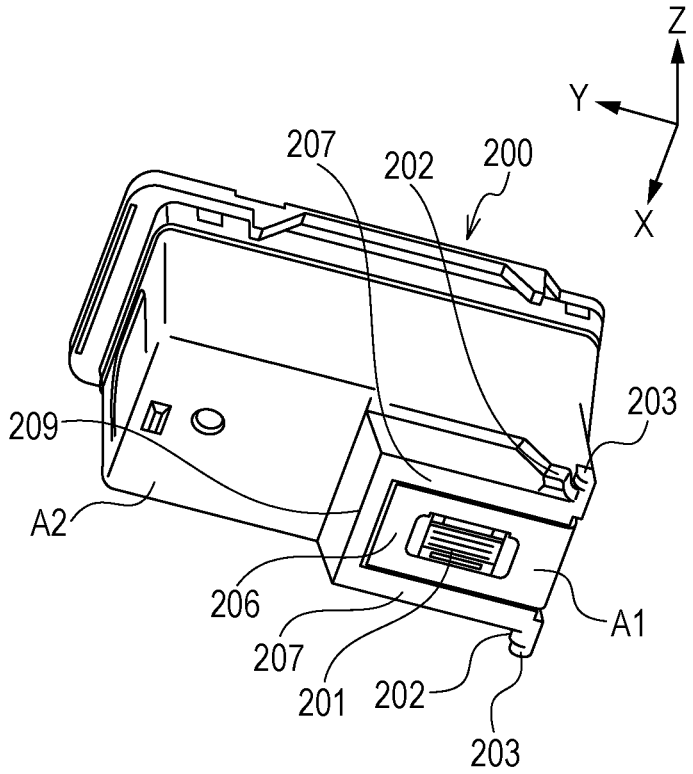

FIG. 3B is a perspective view of the recording head 200 having an ejection port portion 201. The recording head 200 includes the ejection port portion 201, a head bottom abutment surface 202, a contact surface 207, and a contact portion 209.

The recording head 200 has a first surface A1 and a second surface A2. The first surface A1 faces the platen 300. The first surface A1 has the ejection port portion 201 formed therein. The ejection port portion 201 needs to be disposed in the vicinity of the platen 300 in order to eject ink onto the recording medium located on the platen 300 and form an image on the recording medium. Accordingly, the first surface A1 having the ejection port portion 201 formed therein is at a lower height than the second surface A2 so that the distance from the first surface A1 to the platen 300 is less than the distance from the second surface A2 to the platen 300.

For example, a discharge roller 211 (described in more detail below) needs to be disposed in a space facing the second surface A2. Accordingly, the second surface A2 is at a higher height than the first surface A1 so that the distance from the first surface A2 to the platen 300 is greater than the distance from the second surface A1 to the platen 300.

Figure 4:
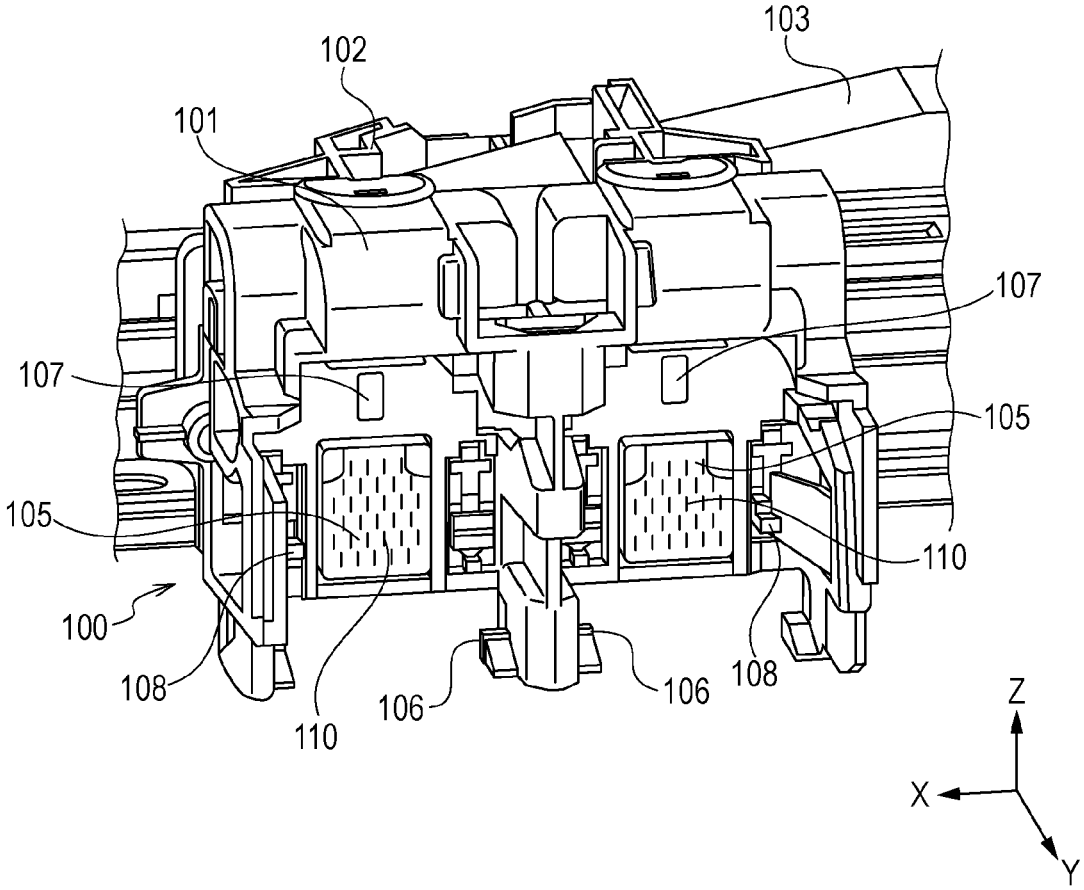
FIG. 4 illustrates a carriage without a recording head mounted therein.

FIG. 4 illustrates the carriage 101 without the recording head 200 mounted therein. A carriage unit 100 includes the carriage 101, the carriage cover 102, a head connector 105, a head set cam 400 (described in more detail below), and a head set cam spring 410 (described in more detail below). The head connector 105 includes contact pins 110. The head connector 105 is soldered to a carriage board (not illustrated). The carriage board is mounted on the carriage 101. The carriage board is electrically connected to the control circuit board 40 illustrated in FIG. 1 via a flexible flat cable (FFC) 103. Upon receiving a signal from a head driver via the FFC 103, the recording head 200 can eject ink in accordance with the data to be recorded.

The carriage 101 includes a carriage bottom abutment surface 106, a carriage top abutment surface 107, and side pressure springs 108.

Figure 5A:
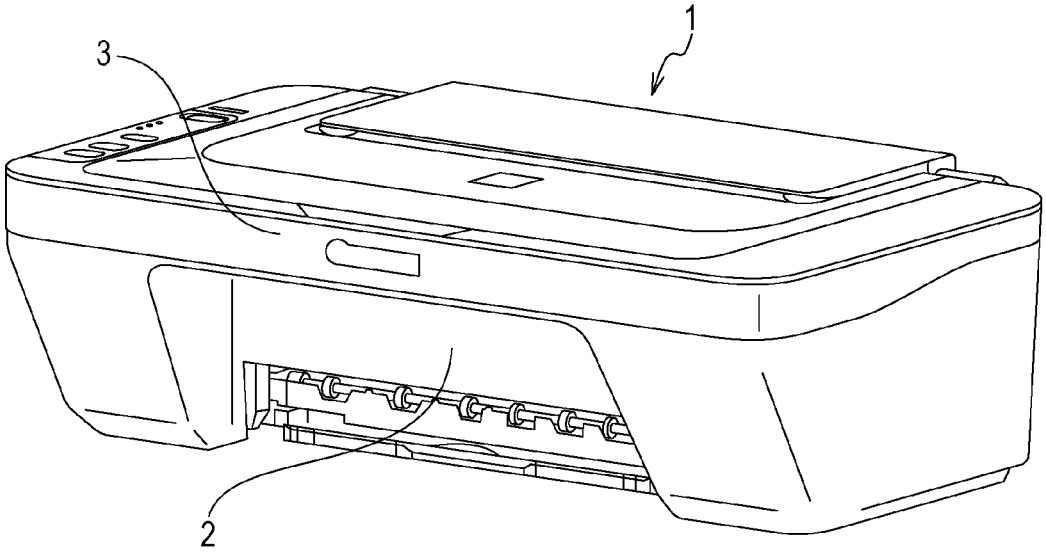
FIGS. 5A and 5B are external perspective views of the inkjet recording apparatus.

FIG. 5A is an external perspective view of an inkjet recording apparatus 1. A scanner unit 3 is fixed to the upper portion of the inkjet recording apparatus 1. An access cover 2 is pivotally supported by the body of the inkjet recording apparatus 1. To replace the recording head 200 with a new one, the access cover 2 is opened.

Figure 5B:
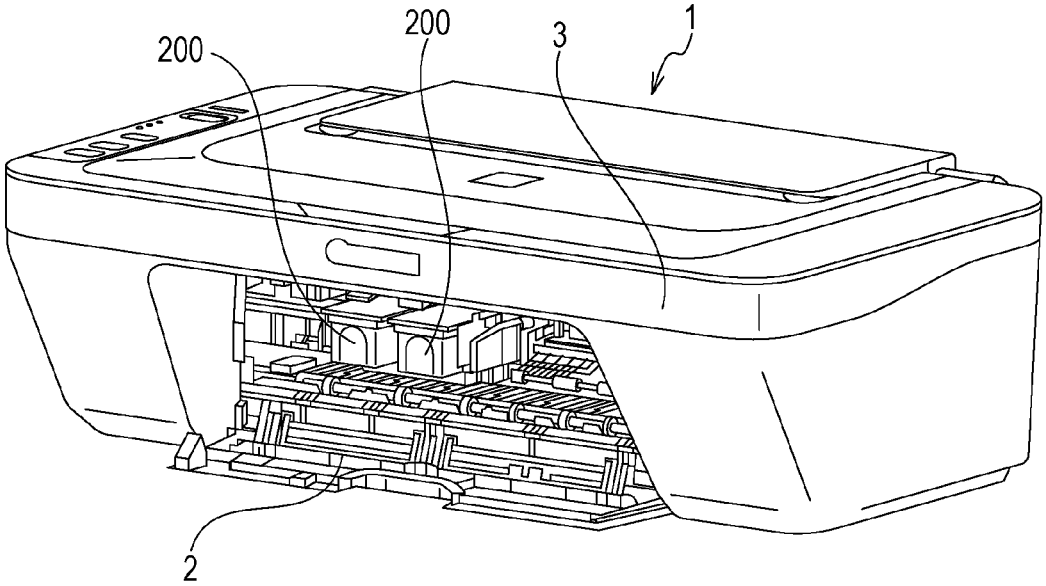

FIG. 5B is a perspective view of the inkjet recording apparatus 1 when the recording head 200 is replaced. If it is detected that the access cover 2 is opened by an access cover sensor (not illustrated), an access cover open signal is sent to the control unit of the control circuit board 40. Upon receiving the access cover open signal, the control unit of the control circuit board 40 moves the carriage 101 to a replacement position 310 illustrated in FIG. 7 (described in more detail below). If the carriage 101 stays at the replacement position 310, the carriage motor 11 is excited and, thus, the carriage 101 cannot be moved.

If the access cover sensor detects that the access cover 2 is closed, an access cover closed signal is sent to the control unit of the control circuit board 40. Upon receiving the access cover closed signal, the control unit of the control circuit board 40 detects whether the recording head 200 is mounted in the carriage 101. If it is detected that the recording head 200 is mounted in the carriage 101, a recording operation can be performed by the recording head 200.

Figure 6A:
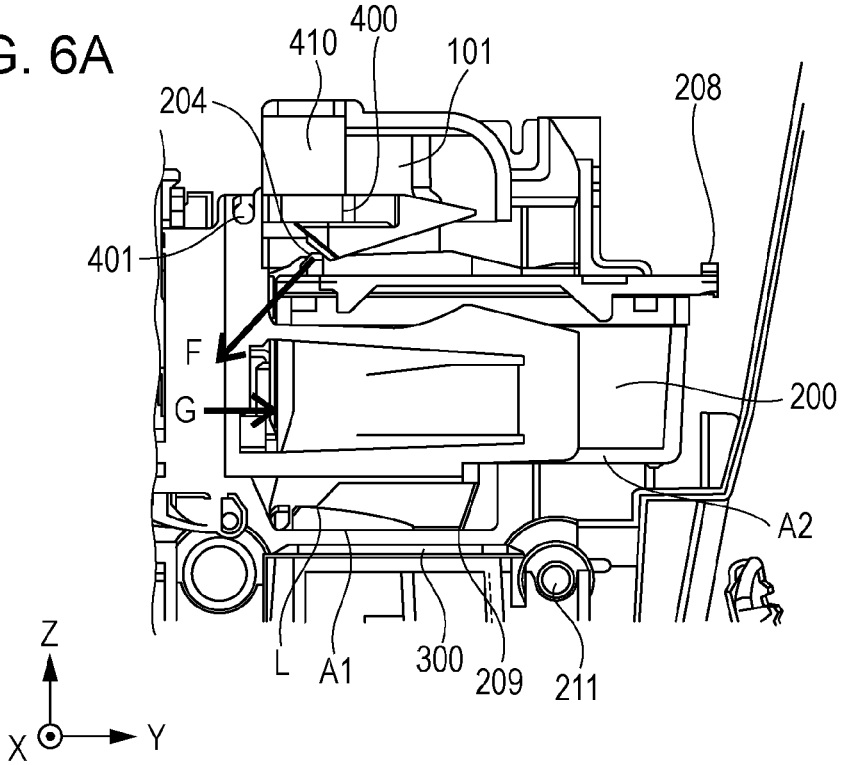
FIGS. 6A and 6B illustrate the carriage having the recording head mounted therein.
Figure 6B:
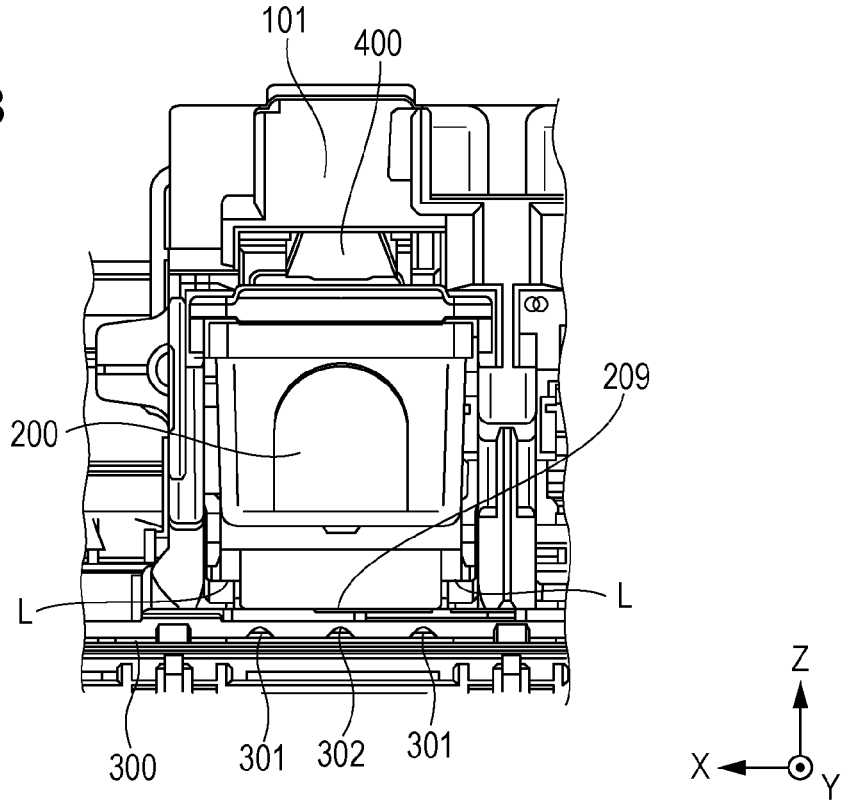

FIG. 6A illustrates the carriage 101 having the recording head 200 mounted therein. In FIG. 6A, the carriage 101 stays at the replacement position 310. FIG. 6B is a front view corresponding to FIG. 6A.

The ejection port portion 201 formed in the first surface A1 ejects ink onto the recording medium located on the platen 300. Thus, an image is formed on the recording medium. The space facing the second surface A2 needs to include a subspace for, for example, the discharge roller 211 to discharge the recording medium. Accordingly, the first surface A1 is at a lower height than the second surface A2 and, thus, the distance from the first surface A1 to the platen 300 is less than the distance from the second surface A2 to the platen 300.

The head set cam 400 receives a force from the head set cam spring 410 and rotates about a shaft 401. If the head set cam 400 rotates and is brought into contact with the pressing portion 204 of the recording head 200, a force is exerted on the pressing portion 204 in a direction of an arrow F. Due to the force in the direction of the arrow F, the recording head 200 is urged by the head connector 105 illustrated in FIG. 4.

The conductor exposed surface 205 of the recording head 200 is urged against the contact pins 110, which elastically deform. Thus, the recording head 200 is electrically coupled with the head connector 105. A reaction force is exerted from the contact pins 110 illustrated in FIG. 4 in a direction of an arrow G illustrated in FIG. 6A. At that time, the head top abutment surface 210 illustrated in FIG. 3A is brought into contact with the carriage top abutment surface 107 illustrated in FIG. 4.

In addition, due to the force in the direction of the arrow G, a Y plane of the head bottom abutment surface 202 illustrated in FIG. 3B, which is a plane perpendicular to a Y-axis, and a Z plane, which is perpendicular to a Z-axis, are brought into contact with the planes of the carriage bottom abutment surface 106 illustrated in FIG. 4 corresponding to the Y plane and Z plane, respectively. In this manner, rotation of the recording head 200 about an X-axis can be stopped.

By urging the recording head 200 toward the middle of the carriage 101 using the side pressure spring 108 illustrated in FIG. 4, an X plane of the head bottom abutment surface 202 that is perpendicular to the X direction is brought into contact with the X plane of the carriage bottom abutment surface 106. In this manner, positioning of the recording head 200 with respect to the carriage 101 in the X direction can be performed.

Figure 7:
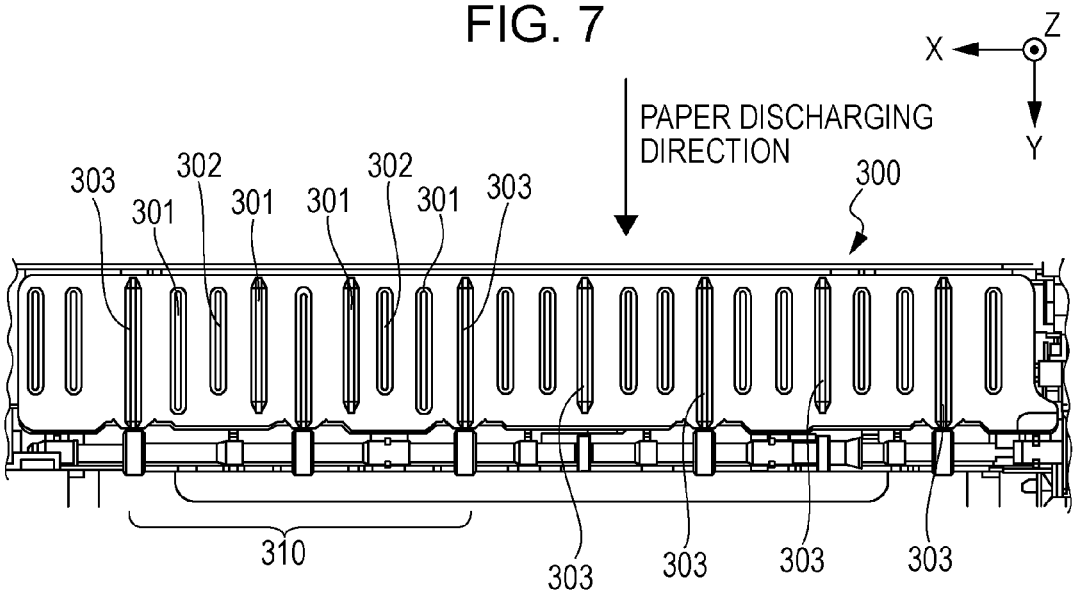
FIG. 7 is a top view of a platen.

FIG. 7 is a top view of the platen 300 illustrated in FIG. 6B. Short ribs 302, which serve as first ribs (opposing ribs), and long ribs 301, which serve as second ribs (contacting ribs), are disposed at the replacement position 310. A replacement operation at which the recording head 200 is mounted in or removed from the carriage 101 is performed at the replacement position 310.

Each of the short ribs 302 is disposed between two of the long ribs 301. Each of the long ribs 301 is longer than the short rib 302 toward the downstream side in the conveyance direction of the recording medium. That is, the long rib 301 extends farther than the short rib 302 toward the downstream side in the conveyance direction. The height of the long rib 301 is the same as that of the short rib 302.

Figure 8:
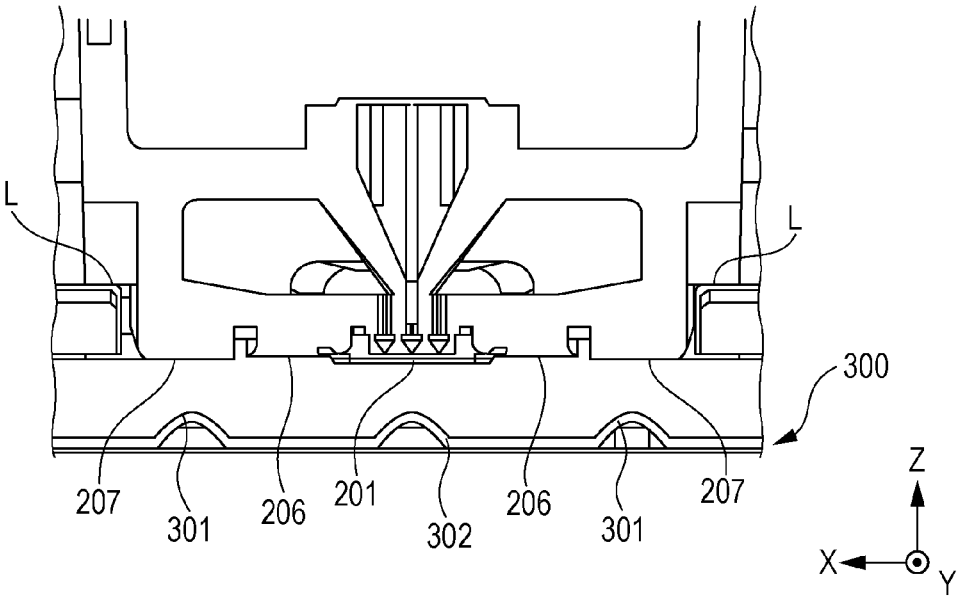
FIG. 8 is a cross-sectional view illustrating the arrangement of an ejection port portion and ribs, as seen from the front of the inkjet recording apparatus.

FIG. 8 is an enlarged cross-sectional view illustrating the arrangement of the ejection port portion 201, the long ribs 301, and the short rib 302 illustrated in FIG. 6B (described in more detail below). Note that FIG. 8 is a cross-sectional view, as seen from the front of the carriage 101. The long ribs 301 face the contact surface 207, but do not face the ejection port portion 201 and the flat panel cable 206. The short rib 302 faces the ejection port portion 201.

Figure 9A:
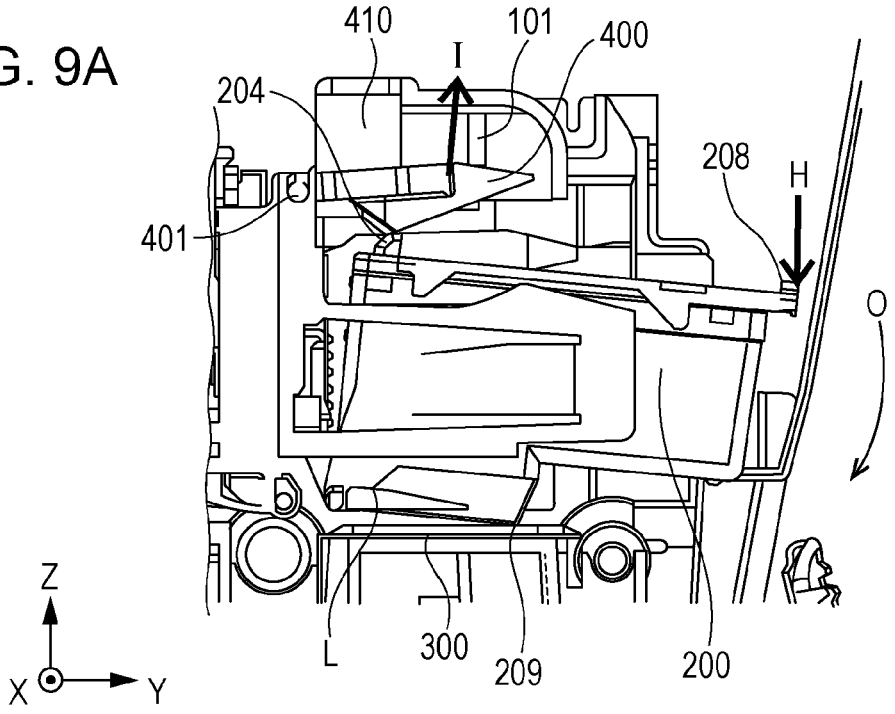
FIGS. 9A and 9B illustrate the operation performed by the recording head to release the pressure of the recording head against the carriage.
Figure 9B:
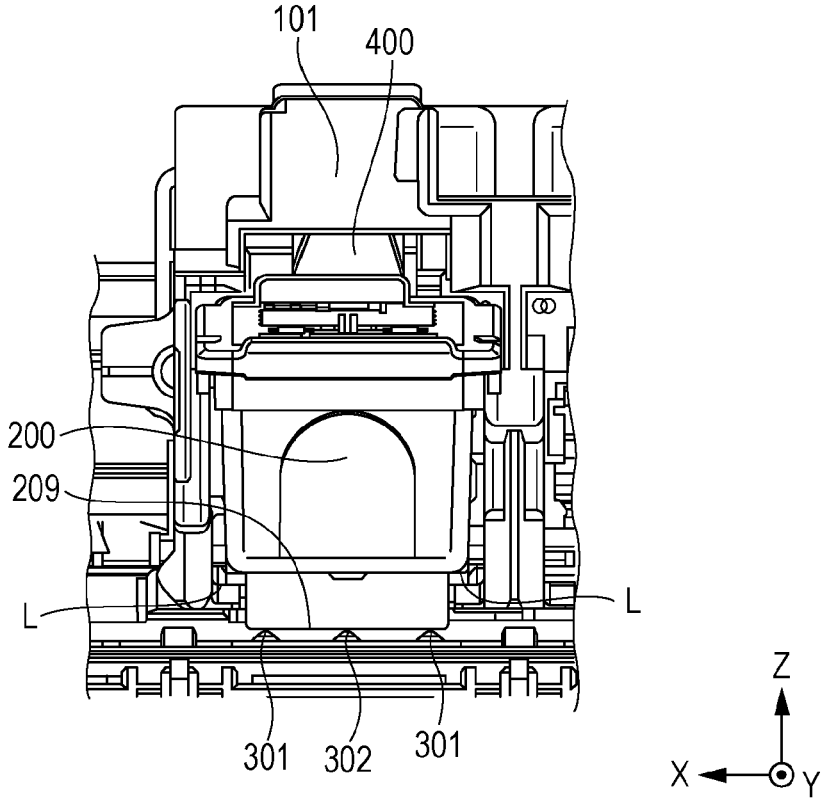

FIGS. 9A and 9B illustrate the operation to release the pressure of the recording head 200 against the carriage 101. FIG. 9A is a left side view, and FIG. 9B is a front view.

If the grip part 208 is pressed down in the direction of the arrow H, the recording head 200 rotates about a ridge line L in a direction of an arrow O. At that time, the recording head 200 rotates in a plane that intersects a moving direction in which the carriage 101 moves. Due to the rotation, the pressing portion 204 presses up the head set cam 400 in a direction of an arrow I and, thus, pressing of the recording head 200 is released.

As illustrated in FIG. 9B, when pressing of the recording head 200 is released, the contact portion 209 is brought into contact with the long ribs 301 and the short rib 302. Thus, the ejection port portion 201 is not in contact with the short rib 302. The contact portion 209 is a portion of the recording head 200 other than the ejection port portion 201. The contact portion 209 is a downstream end portion of the first surface A1 of the recording head 200 in the conveyance direction when the recording head 200 is mounted in the carriage 101. The conveyance direction is a direction in which the recording medium is conveyed.

Figure 10A:
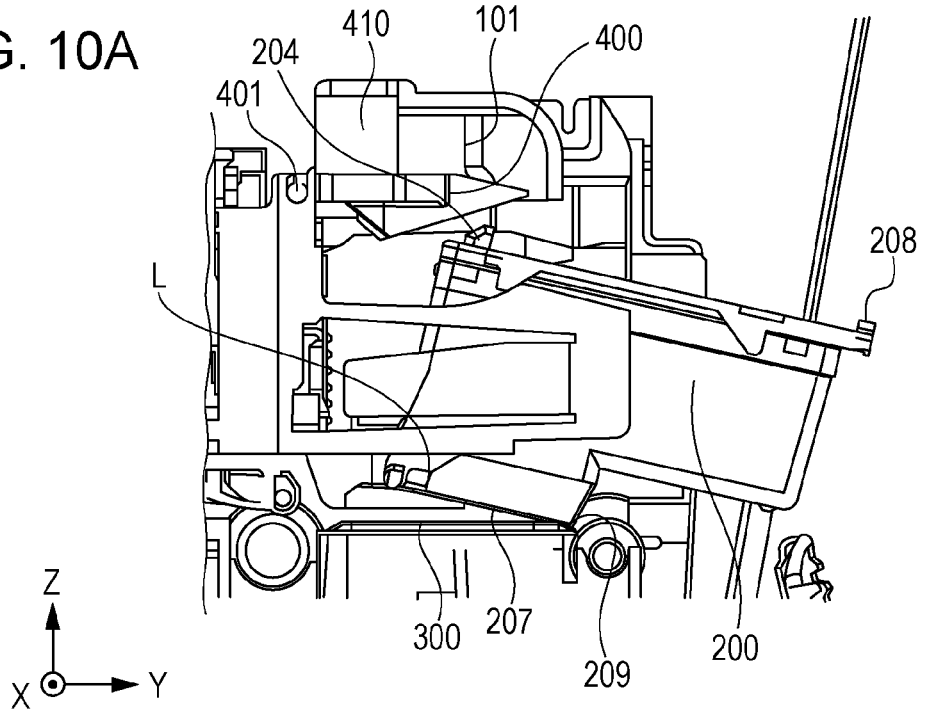
FIGS. 10A and 10B illustrate the operation to remove the recording head from the carriage.
Figure 10B:
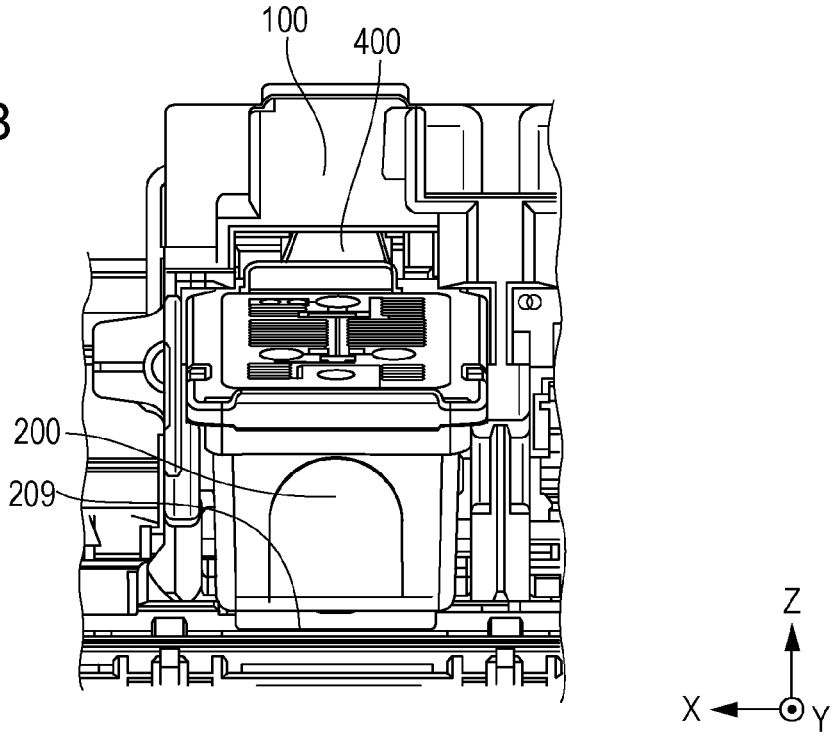

FIGS. 10A and 10B illustrate an operation to remove the recording head 200 from the carriage 101. FIG. 10A is a left side view, and FIG. 10B is a front view. In FIGS. 10A and 10B, the recording head 200 is removed after pressing of the recording head 200 is released.

As illustrated in FIG. 10B, during the removal operation, the contact portion 209 is located on the downstream side of the downstream ends of the long rib 301 and the short rib 302 in the conveyance direction. At that time, the contact surface 207 is in contact with the downstream end of the long rib 301 in the conveyance direction. Accordingly, the ejection port portion 201 is not in contact with the short rib 302. The contact surface 207 is a portion of the recording head 200 other than the ejection port portion 201 and faces the platen 300. The contact surface 207 is a portion of the first surface A1 other than the ejection port portion 201.

As illustrated in FIGS. 9A and 9B and FIGS. 10A and 10B, when the recording head 200 mounted in the carriage 101 is removed after pressing of the recording head 200 is released, a portion of the recording head 200 other than the contact portion 209 and the contact surface 207 is not in contact with the platen 300. Accordingly, when the recording head 200 mounted in the carriage 101 is removed after pressing of the recording head 200 is released, the ejection port portion 201 and the FPC 206 are not in contact with the platen 300. In this manner, damage of the recording head 200 caused by contact of the ejection port portion 201 and the FPC 206 with the platen 300 can be prevented when the recording head 200 is removed.

Figure 11A:
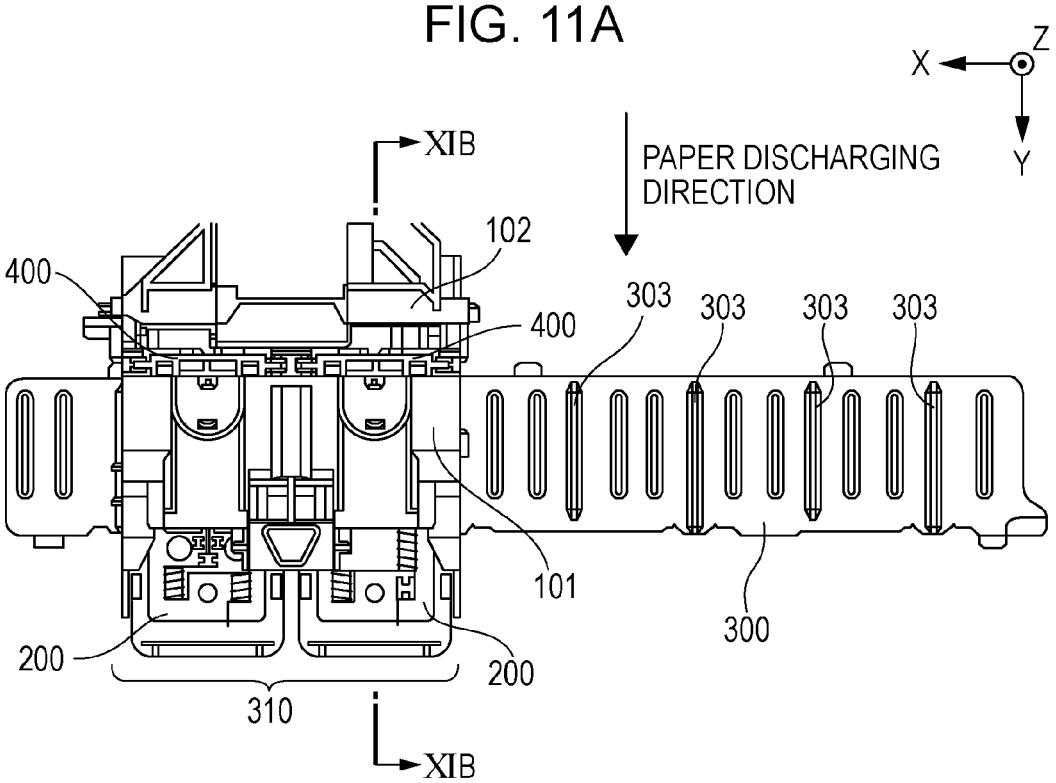
FIGS. 11A and 11B illustrate the carriage located at a replacement position.
Figure 11B:
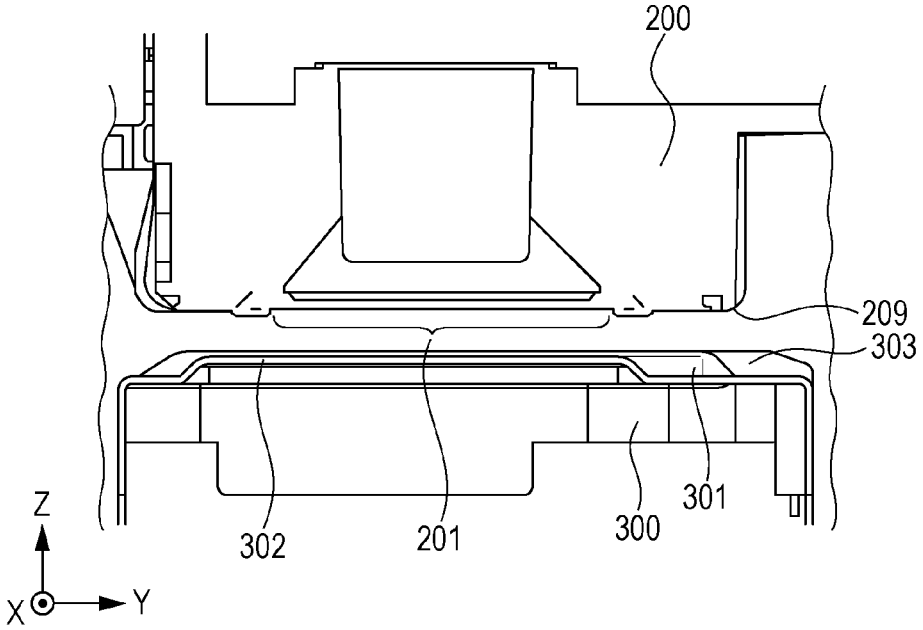

FIGS. 11A and 11B illustrate the carriage 101 located at the replacement position 310. FIG. 11A is a top view, and FIG. 11B is a left cross-sectional view taken along a line XIB-XIB of FIG. 11A. The arrangement of the ejection port portion 201, the long ribs 301, and the short rib 302 illustrated in FIG. 11A is illustrated in FIG. 11B.

The position of a nip between the conveyance roller 21 and the pinch roller 23 in the Z direction is at a higher height than all the ribs of the platen 300. The conveyance roller 21 and the pinch roller 23 convey the recording medium while urging the recording medium against the platen 300. By urging the recording medium against the platen 300, the conveyance roller 21 and the pinch roller 23 create appropriate undulation on the recording medium before ink is ejected from the recording head 200.

As illustrated in FIG. 11B, the short rib 302 extends toward the downstream side in the conveyance direction beyond the ejection port portion 201. In this manner, when ink is ejected from the ejection port portion 201 to the recording medium and, thus, a recording operation is performed, the recording medium is in stable contact with the short rib 302. A high rib 303 is higher than each of the long rib 301 and the short rib 302. A high rib 303 is also formed in an area of the platen 300 other than at the replacement position 310.

In this manner, even at the replacement position 310, appropriate undulation is created on the recording medium at the replacement position 310, as in the area other than the replacement position 310. That is, appropriate undulation is created on the entire area of the recording medium on the platen. As a result, the recording medium can be accurately conveyed on the platen 300.

According to the present invention, when the recording head is replaced, contact of the ejection port portion of the recording head with the platen can be prevented without inclining the rib of the platen. Thus, a recording medium can be stably conveyed while protecting the ejection port portion of the recording head from being damaged when the recording head is replaced above the platen.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-150363 filed Jul. 19, 2013, which is hereby incorporated by reference herein in its entirety.

What is claimed is:

1. An inkjet recording apparatus comprising:

a conveying unit configured to convey a recording medium in a conveyance direction;

a recording head having an ejection port portion for ejecting ink onto a recording medium;

a carriage having the recording head removably mounted therein, the carriage being movable in a direction crossing to the conveyance direction, the carriage being movable to a replacement position at which the recording head is ready for replacement, the replacement position being located in an area which allows the recording medium to pass therethrough;

a platen configured to support the recording medium at a position facing the recording head; and a contacting rib provided on the platen at a position that faces a portion of the recording head other than the ejection port portion when the carriage having the recording head mounted therein is moved to the replacement position, wherein the contacting rib extends on the platen in the conveyance direction.

2. The inkjet recording apparatus according to claim 1, further comprising:

an opposing rib provided on the platen at a position facing the ejection port portion when the carriage having the recording head mounted therein is moved to the replacement position, wherein the contacting rib extends on the platen farther than the opposing rib toward a downstream side in the conveyance direction.

3. The inkjet recording apparatus according to claim 2, wherein when the carriage having the recording head mounted therein moves to the replacement position and a replacement operation for replacing the recording head is performed, the ejection port portion is not in contact with the opposing rib.

4. The inkjet recording apparatus according to claim 2, wherein when the carriage having the recording head mounted therein moves to the replacement position and a replacement operation for replacing the recording head is performed, said portion is in contact with the opposing rib and the contacting rib, so that the ejection port portion is not in contact with the opposing rib.

5. The inkjet recording apparatus according to claim 4, wherein said portion is an end portion on the downstream side of a surface having the ejection port portion.

6. The inkjet recording apparatus according to claim 2, wherein when the carriage having the recording head mounted therein moves to the replacement position and a replacement operation for replacing the recording head is performed, said portion is in contact with an end portion of the contacting rib on the downstream side, so that the ejection port portion is not in contact with the opposing rib.

7. The inkjet recording apparatus according to claim 6, wherein said portion is an end portion on the downstream side of a surface having the ejection port portion.

8. The inkjet recording apparatus according to claim 2, wherein the opposing rib is disposed between two of the contacting ribs.

9. The inkjet recording apparatus according to claim 2, wherein the opposing rib is extends towards the downstream side beyond the ejection port portion located at the replacement position.

10. The inkjet recording apparatus according to claim 1, wherein when the carriage having the recording head mounted therein moves to the replacement position and a replacement operation for replacing the recording head is performed, the recording head rotates in a plane that intersects a direction in which the carriage moves.

11. The inkjet recording apparatus according to claim 10, wherein the replacement operation is performed in such a way that the recording head rotates at the replacement position so as to be closer to the platen.

* * * * *